US011585498B2

(12) United States Patent
Findlay et al.

(10) Patent No.: US 11,585,498 B2
(45) Date of Patent: Feb. 21, 2023

(54) HINGED CHANNEL SYSTEM FOR LINEAR LIGHTING

(71) Applicant: Elemental LED, Inc., Reno, NV (US)

(72) Inventors: Alexander L. Findlay, Bournemouth (GB); James Edward Stillman, Guangdong (CN)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/407,474

(22) Filed: Aug. 20, 2021

(65) Prior Publication Data

US 2022/0057055 A1 Feb. 24, 2022

Related U.S. Application Data

(60) Provisional application No. 63/068,522, filed on Aug. 21, 2020.

(51) Int. Cl.
*F21S 4/28* (2016.01)
*F21V 19/00* (2006.01)
(Continued)

(52) U.S. Cl.
CPC ..... *F21S 4/28* (2016.01); *F21V 17/02* (2013.01); *F21V 19/003* (2013.01); *F21V 23/06* (2013.01); *F21Y 2115/10* (2016.08)

(58) Field of Classification Search
CPC ..... F21S 4/28; F21V 17/02; F21V 19/003; F21V 23/06; F21Y 2115/10
(Continued)

(56) References Cited

U.S. PATENT DOCUMENTS 9,239,136 B1 1/2016 Petersen et al.
2012/0236484 A1* 9/2012 Miyake ..... G06F 1/1641 361/679.01
(Continued)

FOREIGN PATENT DOCUMENTS

KR 20100108085 A 10/2010
KR 20110022262 A 3/2011
KR 20140066129 A 5/2014

OTHER PUBLICATIONS

English translation of KR 2010-0108085 A (Year: 2010).*
(Continued)

*Primary Examiner* — Britt D Hanley
*Assistant Examiner* — Hana S Featherly
(74) *Attorney, Agent, or Firm* — United IP Counselors, LLC

(57) ABSTRACT

A channel system that includes a first channel section, a second channel section, and a hinge joint between the first and second channel sections is disclosed. The hinge joint allows the first channel section to fold against the second channel section for storage and shipping of the channel system. In one embodiment, the hinge joint itself includes a hinge member that extends between the two channel sections and bends hingedly to allow movement and two intermediate endcaps, which cap the channel sections on either side of the hinge joint. The hinge joint may be designed to "snap back" to a fully extended position. Mechanical securement structure may be added to the first channel section and the second channel section to improve force and retention during the "snap back" movement.

6 Claims, 6 Drawing Sheets

(51) Int. Cl.
*F21V 17/02* (2006.01)
*F21V 23/06* (2006.01)
*F21Y 115/10* (2016.01)

(58) Field of Classification Search
USPC ..... 362/217.14
See application file for complete search history.

(56) References Cited

U.S. PATENT DOCUMENTS

| | | | | |
|---|---|---|---|---|
| 2015/0003583 | A1* | 1/2015 | Wang | G01N 23/04 378/57 |
| 2017/0329567 | A1* | 11/2017 | Choi | H05K 5/0021 |
| 2020/0100372 | A1 | 3/2020 | Hirakata et al. | |

OTHER PUBLICATIONS

International Search Report issued in International Application No. PCT/US2021/046866 dated Dec. 1, 2021.
Written Opinion issued in International Application No. PCT/US2021/046866 dated Dec. 1, 2021.

* cited by examiner

HINGED CHANNEL SYSTEM FOR LINEAR LIGHTING

CROSS-REFERENCE TO RELATED APPLICATIONS

This application claims priority to, and the benefit of, U.S. Provisional Patent Application No. 63/068,522, filed Aug. 21, 2020. The contents of that application are incorporated by reference herein in their entirety.

TECHNICAL FIELD

The invention relates to channels for linear lighting.

BACKGROUND

Linear lighting is a class of lighting based on light-emitting diodes (LEDs) in which an elongate, narrow printed circuit board (PCB) is populated with a plurality of LED light engines, typically spaced from one another at a regular pitch or spacing. In much of the linear lighting on the market, the LED light engines are surface-mounted on the PCB, along with other components. The PCB itself may be either rigid or flexible.

Connected to power, a strip of linear lighting may be considered a luminaire in its own right, and linear lighting is also used as a raw material in the construction of more complex luminaires. The most common way to make a strip of linear lighting into a finished luminaire is to place it in a channel and cover it with a cover. The channel allows for installation in various locations, depending on its features, and both the cover and the channel serve to protect the linear lighting, to dissipate heat and, generally, to ensure its longevity. The cover may also include light-diffusing or light-directing features.

Channels are most commonly elongate with a constant cross-section, made by extruding a metal or plastic. The most common material for channels is anodized, extruded aluminum, although extruded plastic channels are used for some applications. Especially for shorter lengths or specialty applications, channels may also be machined or cast from either metallic or polymeric materials. U.S. Pat. No. 9,239,136 describes a number of metal channels and mechanisms for mounting them in various locations. U.S. Pat. No. 10,753,596 describes resin-casting methods that can be used to produce channels. The contents of both of those patents are incorporated herein in their entireties.

The difficulty with traditional channels is their typical manufactured length. Channels for the U.S. market are usually made in 8-foot (2.4-meter) lengths. This long length makes shipping and storage more complicated, and generally raises shipping and handling costs. It may also necessitate special machinery or supports in the manufacturing plant in order to effectively process and cut the 8-foot lengths of channel into desired lengths.

BRIEF SUMMARY

Aspects of the invention relate to a channel system that includes a first channel section, a second channel section, and a hinge joint between the first and second channel sections. The hinge joint allows the first channel section to fold against the second channel section for storage and shipping of the channel system. In one embodiment, the hinge joint itself includes a hinge member that extends between the two channel sections and bends hingedly to allow movement and two intermediate endcaps, which cap the channel sections on either side of the hinge joint. The hinge member may, e.g., insert through low-profile slots in each of the intermediate endcaps and be secured within the channel sections. The hinge joint may be configured to "snap" into a fully extended position. To that end, the hinge member may have a convex camber or other such features that allow it to return to a position that corresponds with the fully extended position. If the hinge member itself cannot provide enough force, aligned magnets may be provided in the intermediate endcaps in order to draw the channel sections together.

The channel system may include its own power elements, such as a driver in one of the channel sections. Typically, electrical connections between the two channel sections would convey power between them.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
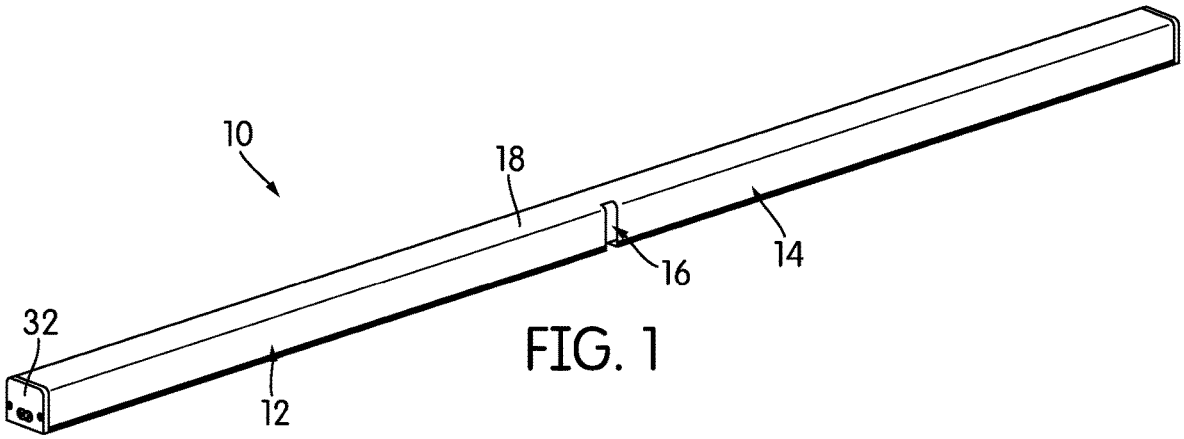
FIG. 1 is a perspective view of a channel system for linear lighting according to one embodiment of the invention.

FIG. 1 is a perspective view of a channel system for linear lighting, generally indicated at 10, according to one embodiment of the invention. The channel system has a first channel section 12, a second channel section 14, and a hinge joint 16 connecting the first channel section 12 and the second channel section 14. As will be explained below in greater detail, in the channel system 10, the two channel sections 12, 14 fold relative to one another for shipping and storage. In the view of FIG. 1, a cover 18 covers the entire channel system 10, extending over both of the channel sections 12, 14.

Figure 2:
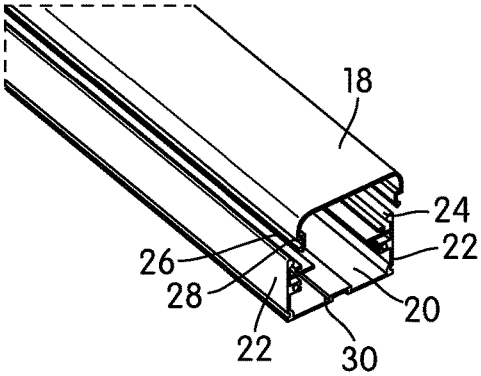
FIG. 2 is an exploded perspective view of the channel of FIG. 1.

FIG. 2 is an exploded perspective view of one end of a channel section 12, 14, illustrating the cross-sectional profile of a channel section 12, 14 and its engagement with the cover 18. The channel sections 12, 14 are elongate with a constant cross-section, such that both channel sections 12, 14 are substantially identical to one another, although endcaps and other features inserted into them differentiate them in practice. This description assumes that the channel sections 12, 14 are rigid, or at least, that they are stiff enough that they cannot be bent without damage. Portions of this description may assume that the channel sections 12, 14 are made of an extruded metal, such as aluminum or steel, although in some cases, the channel sections 12, 14 may be machined, cast, or made by some other process, particularly if the channel sections 12, 14 are short. In many embodiments, though, the two channel sections 12, 14 will not be particularly short. For example, in one embodiment, the overall length of the channel system 10 will be 8 feet (2.4 meters), with channel sections 12, 14 that are each about 4 feet (1.2 meters) in length. Thus, the channel system 10 has a full 8-foot length, but folds to a more convenient size for shipping.

The channel section 12, 14 has a bottom 20 and a pair of sidewalls 22 that are spaced apart by, and arise from, the bottom 20, forming a U-shape. As those of skill in the art will realize, though, there are a number of different possible profiles for a linear lighting channel, of which the shape shown in FIG. 2 is only one. The upper portions of the sidewalls 22 have cover-engaging structure 24 which, in this case, is an inwardly-extending ridge. The cover 18 has depending legs 26 with corresponding structure 28 to engage the structure 24 of the sidewalls 22. In this embodiment, the depending legs 26 of the cover 18 fit within the sidewalls 22 of the channel section 12, 14, but in other embodiments, the sense may be reversed, and the depending legs 26 of the cover 18 may fit over the sidewalls 22.

Figure 3:
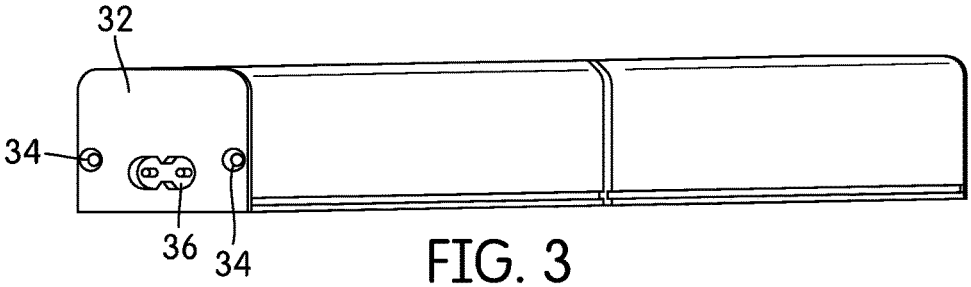
FIG. 3 is a perspective view of the channel of FIG. 1 from one end, illustrating an endcap.

As can also be seen in FIG. 2, each of the sidewalls 22 has inwardly-extending structure 30 that can be used to capture and retain an endcap. FIG. 3 is an end-perspective view of the channel system 10, illustrating one of its ends capped with an endcap 32. In the illustrated embodiment, the endcap-securing structure 30 on each sidewall 22 comprises a flange with sufficient extent to have a hole for securing a fastener. This hole may be, e.g., a threaded hole.

The endcap 32 itself, which may be made of plastic, metal, or any other suitable material, includes holes 34, which may be counterbored, allow for the insertion of fasteners to secure the endcap 32 to the channel section 12, 14. While traditional fasteners, such as machine screws, may be used, the type of fastener is not critical. In other embodiments, clips, Christmas-tree fasteners, and other such fasteners may be used. In yet other embodiments, fasteners may be omitted, and the connection between the endcap and the channel section may rely on a tight frictional fit or an interference fit. In some cases, adhesives may replace fasteners.

In a typical linear lighting channel, two endcaps are used, one on each end of the channel, and the two endcaps are structurally different from one another. One endcap typically provides some way to convey power into the channel for the linear lighting, while the other endcap is a blank endcap that merely seals the opposite end. In some cases, two power-conveying endcaps may be used if independent sections of channel are to be connected together with cabling to convey power between them, a practice referred to as "daisy-chaining" channels. The endcap that is used to convey power may have a plain opening to pass a cable, a strain relief for a cable, or a specific connecting structure. As shown in FIG. 3, the endcap 32 has a female, two-prong socket 36 capable of accepting an appropriate power cord. Of course, in various embodiments of the invention, the endcap may have any of the features described above.

Figure 4:
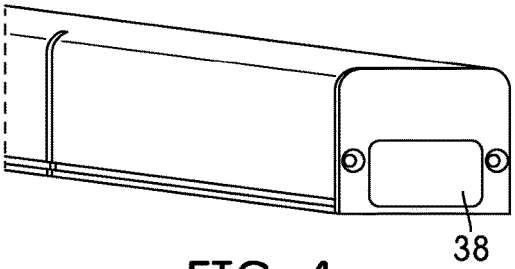
FIG. 4 is a perspective view of the channel of FIG. 3, illustrating a plug for the endcap.
Figure 5:
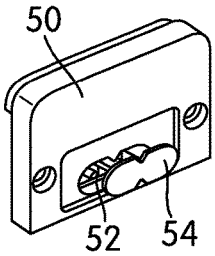
FIG. 5 is an exploded perspective view of a channel endcap according to another embodiment of the invention, shown with its plug.

The other endcap of the channel system 10 may have all of the features of the endcap 32 without the socket 36. Alternatively, there may be only one endcap 32 used in the channel system 10 with the socket 36 of the endcap 32 capped when not needed. FIG. 4 illustrates a cap or plug 38 placed over the socket 36. In the view of FIG. 4, the plug 38 is rectilinear with an inwardly-projecting with a shape that is complementary to that of the socket 36. FIG. 5 shows a variation of this, an endcap 50 with a recessed socket 52. The socket 52 is plugged with a plug 54 that more directly corresponds with the shape of the socket 52.

Figure 6:
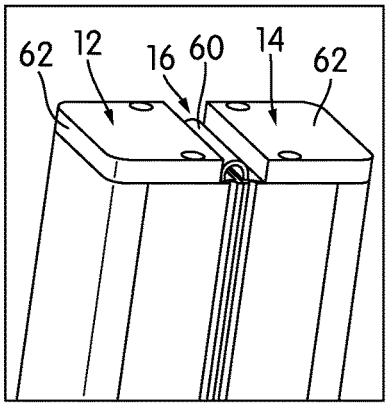
FIGS. 6-8 are perspective views illustrating the range of motion of the hinge joint of the channel system of FIG. 1.
Figure 7:
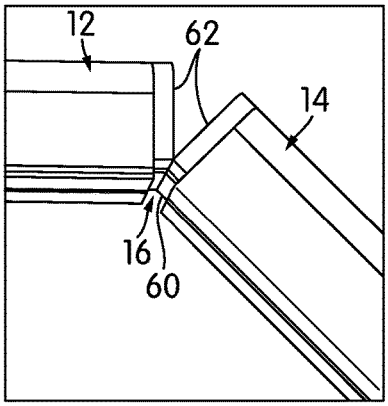
Figure 8:
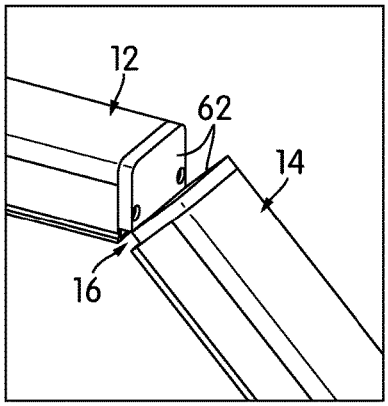

FIGS. 6-8 are perspective views of the area around the hinge joint 16, illustrating its bending and the ability of the channel system 10 to assume different positions in storage and use. In particular, in the view of FIG. 6, the hinge joint 16 is fully bent, leaving the two channel sections 12, 14 with an approximately 180° angle between them. In FIG. 7, a side perspective view, the hinge joint 16 has the two channel sections 12, 14 at an acute angle with respect to one another. FIG. 8 is a perspective view showing the acute angle of FIG. 7 from another perspective.

Figure 9:
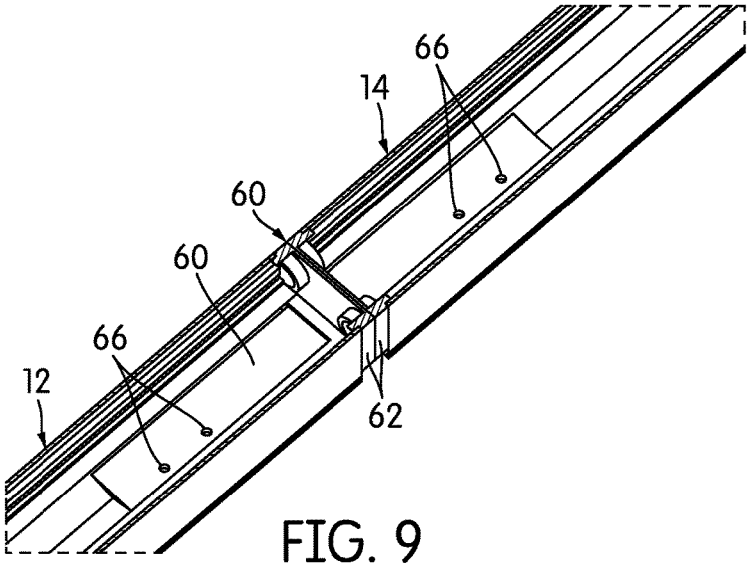
FIG. 9 is a perspective view of the channel system from above with no cover installed.
Figure 10:
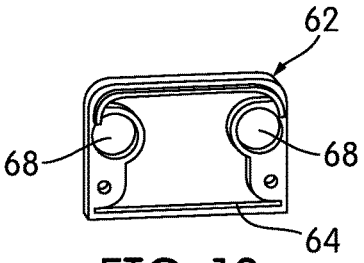
FIG. 10 is a perspective view of the interior face of an intermediate endcap of the channel system of FIG. 1.
Figure 17:
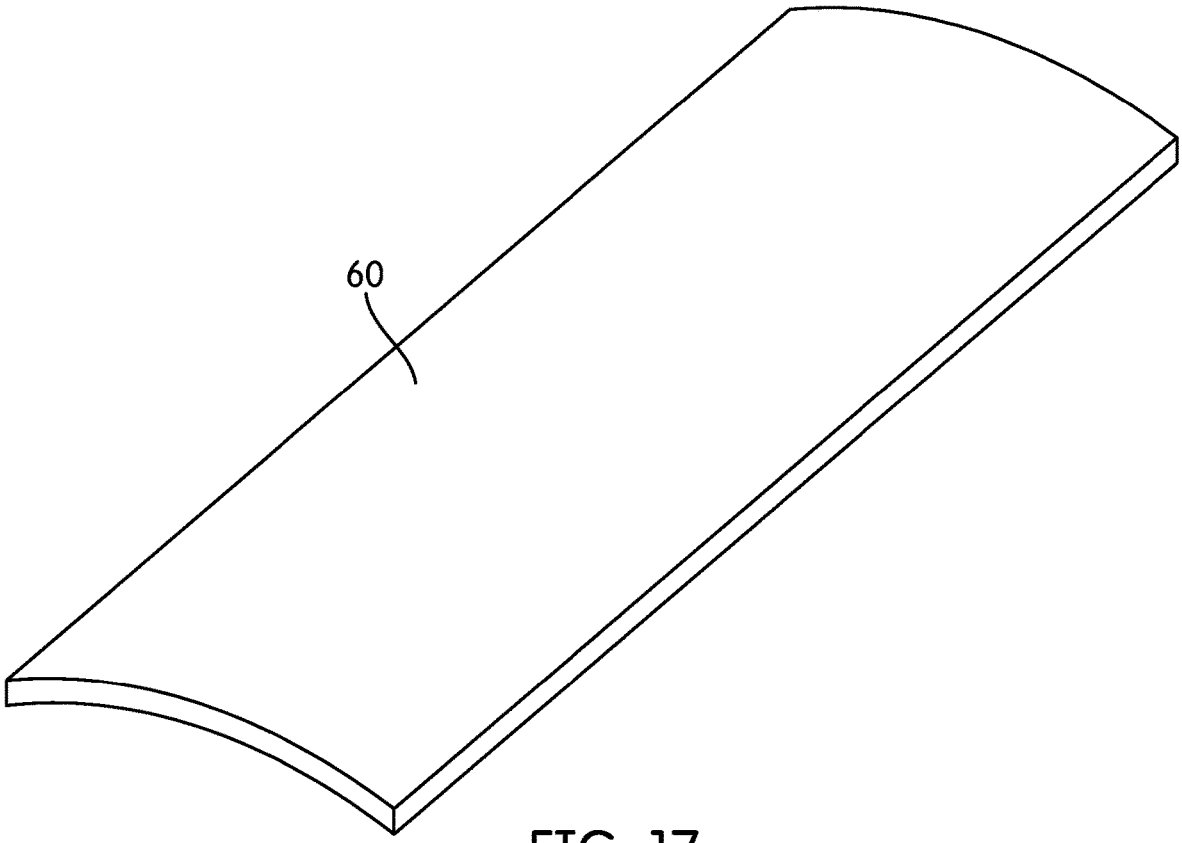
FIGS. 17 and 18 are a perspective view and an end view, respectively, of the hinge member illustrated in FIGS. 6-9.
Figure 18:
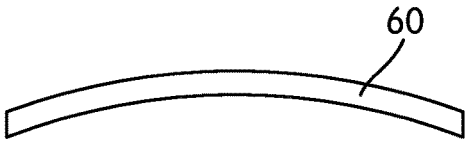

The hinge joint 16 is primarily comprised of a hinge member 60 and a pair of intermediate endcaps 62, one capping the hinge-end of each of the channel sections 12, 14. The hinge member 60 can be more readily seen in FIG. 9, a perspective view of the channel system 10 near the hinge joint 16 with no cover. In a general sense, any material that is flexible but stiff enough to hold together can be used for the hinge member 60. However, it is advantageous if the hinge member 60 is at least somewhat resilient and/or capable of returning to the position it assumes when the two intermediate endcaps 62 abut each other such that the channel system 10 is at its full length. The shape of the hinge member 60 may contribute to this. For example, the hinge member 60 may be made of a metal with a convex camber as illustrated in FIGS. 17 and 18 and that allows it to be bent, but will "snap" back to its original shape. The hinge member 60 extends between the two channel sections 12, 14 inserting through a low-profile groove 64 in each of the intermediate endcaps 62, as can be seen in FIG. 10, a perspective view of the interior-facing side of one of the intermediate endcaps 62. As shown in FIG. 9, each side of the hinge member 60 includes fastener openings 66 to secure the hinge member 60 to the channel bottom 20. Of course, the hinge member 60 may be secured anywhere in various embodiments, including along the exterior of the channel sections 12, 14.

If the hinge member 60 does not have sufficient resilience to return to its unfolded position and stay there, or if the force of the snapping motion is not sufficient, other mechanical securement structure may be provided. For example, magnets may be added to the intermediate endcaps 62 with poles aligned so as to draw the endcaps 62 together. Magnet positions 68 are provided on the interior side of the intermediate endcaps 62. The magnet positions 68 shown in FIG. 10 are round with a raised wall around at least a portion. This may help to establish proper magnet alignment, although magnets may be added without such convenient features.

Any type of linear lighting may be used in the channel system 10 and in channel systems according to other embodiments of the invention. The linear lighting may be flexible or rigid, and it may be of the constant-voltage type or of the constant-current type. In at least some embodiments, the linear lighting will be rigid linear lighting made with a rigid printed circuit board (PCB), such as an FR4 ceramic PCB. The linear lighting may be configured to rest in the channels formed in the bottom 20 of the channel or, in some embodiments, on the sidewalls 22. Direct contact with the bottom 20 will typically provide better heat sinking and dissipation. The end or ends of the channel sections 12, 14 may include power circuitry, such as a driver for the linear lighting. In most embodiments, power would be conveyed from one channel section 12 to the other.

The channel system may include its own power elements, such as a driver in one of the channel sections. A "driver," as the term is used here, refers to an element that is designed to supply power in a form acceptable to the linear lighting, typically low-voltage, direct-current (DC) power, by converting power from a first form into a second form. The term "low voltage" varies according to the authority one consults, but for purposes of this description, should be considered to be any voltage under about 50V. For example, the driver may take household or commercial voltage at 110-240 VAC, e.g, from the socket 36, and convert it to low-voltage DC.

Figure 11:
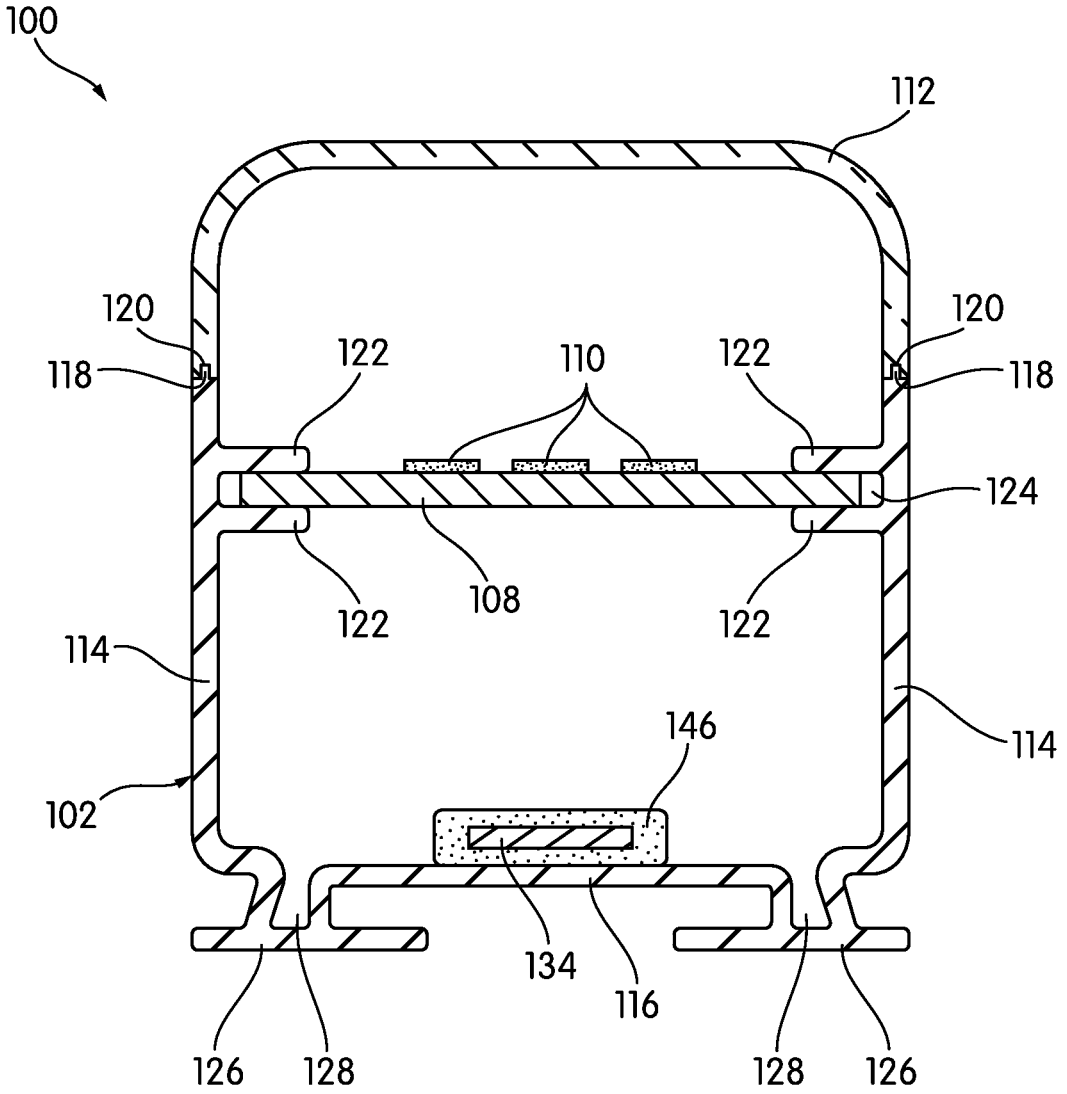
FIG. 11 is a cross-sectional view of a channel system according to another embodiment of the invention.
Figure 12:
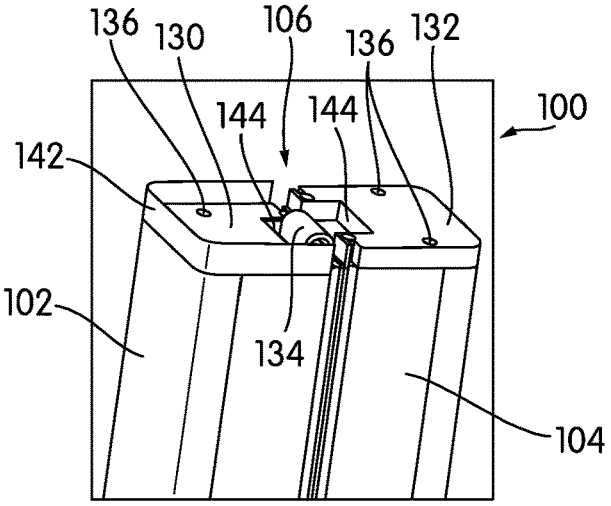
FIGS. 12-14 are perspective views illustrating the range of motion of a hinge joint according to another embodiment of the invention.
Figure 13:
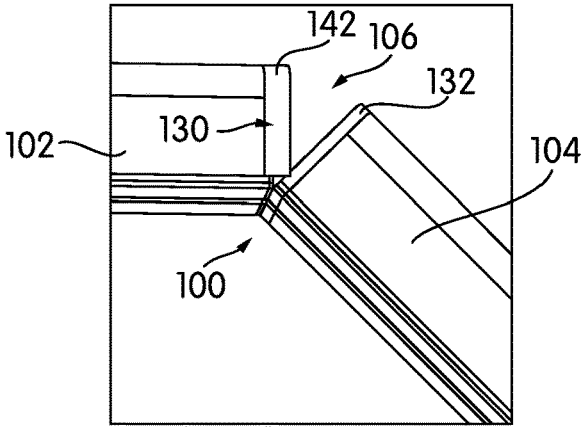
Figure 14:
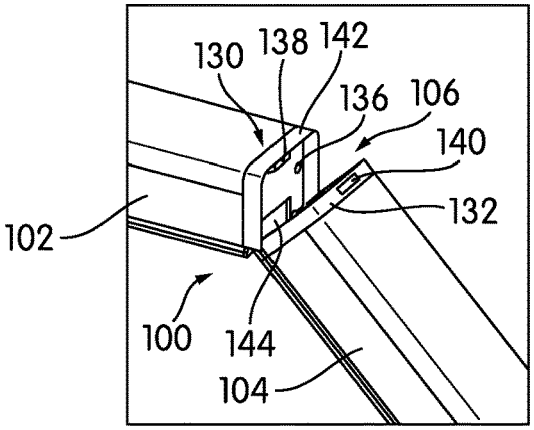

FIG. 11 is a cross-sectional view of a first channel section 102 of a channel system, generally indicated at 100, according to another embodiment of the invention, and FIGS. 12-14 are perspective views illustrating a hinge joint 106 between channel sections 102, 104 of the channel system 100.

The first channel section 102 of the channel system 100 has many features similar to the channel system 10 described above. Notably, as shown in FIG. 11, a PCB 108 carrying one or more LED light engines 110 is positioned in the first channel section 102. A cover 112 covers the first channel section 102. The first channel section 102 has a pair of sidewalls 114 that are spaced apart by and arise from a bottom 116, forming a U-shape. Similar to the channel sections 12, 14 described above, the first channel section 102 may have any of a number of different possible profiles for a linear lighting channel. In the illustrated embodiment, the first channel section 102 and the second channel section 104 each have the same substantially constant cross-section and the same features. For the sake of simplicity, only the first channel section 102 is depicted in FIG. 11 and described in detail. While it will usually be the case that each section 102, 104 of a channel system 100 has the same cross-section and features, that need not be the case in all embodiments.

Similar to the channel system 10 described above, and as shown in FIG. 12, a hinge joint 106 connects the first channel section 102 and the second channel section 104. FIG. 12 is a perspective view of the area around the hinge joint 106 with the hinge joint 106 fully bent, and FIGS. 13 and 14 show the hinge joint 106 in states of partial bending. Generally speaking, the position of the two channel sections 102, 104 shown in FIG. 12 is the position that would be assumed during shipping and storage. The positions of the two channel sections 102, 104 shown in FIGS. 13 and 14 are transitory positions that would typically only be assumed momentarily while snapping the two channel sections 102, 104 into their final straight, aligned configuration.

As can be seen in FIG. 12, the hinge joint 106 includes a first intermediate cap 130, a second intermediate cap 132, and a hinge member 134 that connects the first and second channel sections 102, 104. In the channel system 10 described above, magnets in designated positions 68 were provided to act as additional mechanical securement structure to keep the sections 12, 14 in place once unfolded and to prevent sagging. The main difference between the channel system 10 described above and the channel system 100 is that, in the channel system 100, the hinge joint 106 locks the channel system in the unfolded configuration using a mechanical lock mechanism. The parts of this mechanical lock mechanism are found in the intermediate caps 130, 132 that cap off the individual channel sections 102, 104 and, in this case, include a tab 138 in the first intermediate endcap 130 adapted to snap into a slit 140 in the second intermediate cap 132.

The mechanical lock mechanism and its cooperating engaging structures 138, 140 secure the first and second channel sections 102, 104 so that they extend substantially along the same axis with minimal bending or bowing at the hinge joint 106. Thus, in the unfolded configuration, the first and second channel sections 102, 104 are substantially colinear such that the channel system 100 extends generally straight and has substantially the same appearance and lighting effect as if it were comprised of a single channel.

While magnets are certainly one effective way of providing additional mechanical securement for a channel system 10, 100, a mechanical lock mechanism of the type shown in the channel system 100 has certain advantages. For example, it may be less expensive to implement, and requires fewer parts and fewer assembly steps. Moreover, while a depending tap 138 and corresponding slit 140 are shown in the figures, the exact nature of the mechanical elements is not critical, so long as they can provide the kind of positive and definite engagement that will prevent the unfolded channel system 100 from sagging. It is also helpful, although not required, that the elements 138, 140 provide an easily detected indication that they are engaged, e.g., by a snapping or clicking sound when they engage.

As can be seen in these figures, the first intermediate cap 130 includes a hood 142 that overlaps with the second intermediate cap 132 in the unfolded configuration. The hood may create the appearance of a seamless transition between the first and second channel sections 102, 104 so that they appear more like a full-length linear luminaire with a continuous channel.

The hinge member 134 may include additional structure to protect and/or support it. As can be seen particularly in FIG. 11, the hinge member 134 includes a flexible covering 146. The flexible covering 146 may be a suitable flexible material, such as an elastomer or flexible plastic. The covering 146 may mechanically isolate the hinge member 134 from connecting structure extending between the first channel section 102 and the second channel section 104 to prevent damaging the connecting structure during movement of the hinge joint 106. The covering 146 may also electrically isolate the hinge member 134 from the connecting structure.

Figure 15:
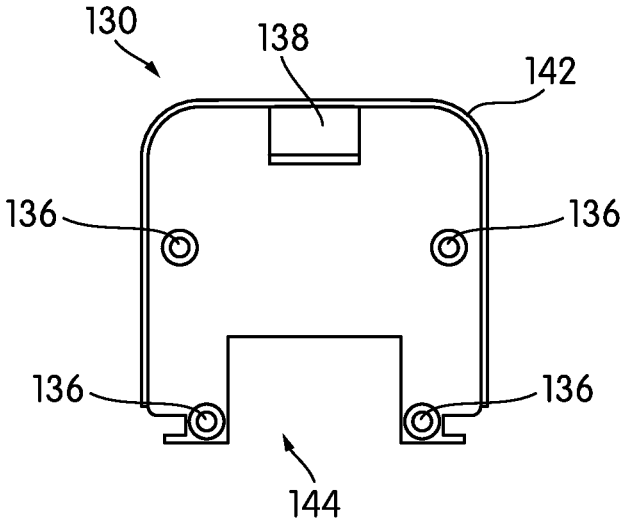
FIG. 15 is front elevational view of a first intermediate endcap of the hinge joint of FIG. 12.
Figure 16:
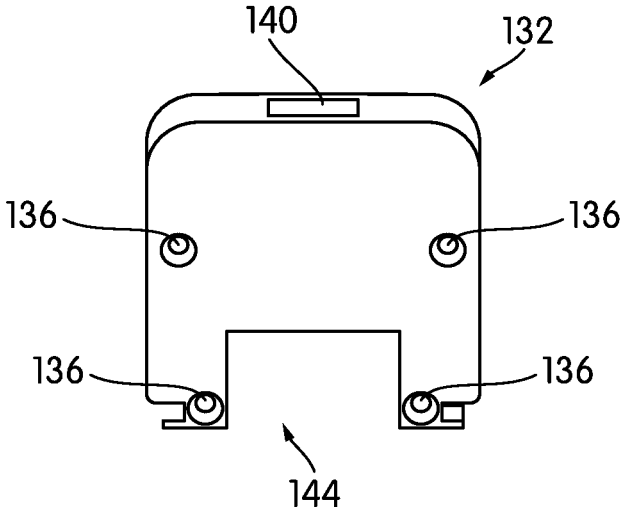
FIG. 16 is a front elevational view of a second intermediate endcap of the hinge joint of FIG. 12.

In addition to providing mechanical connection between adjacent channel sections 102, 104, the hinge joint 106 allows electrical connecting structure, such as wires or cables, to pass between channel sections 102, 104 to connect their respective PCBs 108. FIGS. 15 and 16 are a front elevational view and a front perspective view of the first and second intermediate caps 130, 132, respectively. As can be seen in these figures, each of the caps 130, 132 has a slot 144. The slots 144 are arranged so as to be aligned with one another when the channel system 100 is fully extended and snapped together. Each slot 144 is sized to accommodate the hinge member 134 and any other connecting structure or structures that may be present. While a rectangular slot 144 is shown, any shape of slot may be used, and the slot may be sized to be just larger than the structures that are passing through it. In some cases, the perimeters of the slots 144 may be grommeted or sealed against the structures that pass through it to provide for greater ingress protection for the channel sections 102, 104.

Beyond the inclusion of a slot 144, the intermediate end caps 130, 132 are relatively simple. As shown in FIGS. 15 and 16, they include fastener openings or holes 136 for fasteners, but that need not be the case in all embodiments. In some embodiments, the holes 136 and fasteners may be omitted, and the connection between the intermediate caps 130, 132 and the channel sections 102, 104 may rely on sonic welding, a tight frictional fit, or an interference fit. In some cases, adhesives may be used.

The hinge member 134 itself has the same features as the hinge member 60 and extends between the first and second channel sections 102, 104 in the same manner as the hinge member 60 described above and shown in FIG. 9. Specifically, the hinge member 134 is adapted to be bent to allow the channel system 100 to fold but will "snap" back to its original shape for the channel system 100 to assume an unfolded configuration, similar to that shown in FIG. 1. As with the channel system 10 described above, the hinge member 134 itself may be secured to the channel sections 102, 104 with fasteners, by adhesives, by welding (e.g., sonic welding), or by other means.

Because a mechanical lock mechanism is used between adjacent channel sections 102, 104, rigidity and resilience may not be critical in all embodiments of the hinge member 134, i.e., the hinge member 134 need not always be constructed of a material like spring steel. In some cases, it may be sufficient for a hinge member to hold adjacent channel sections 102, 104 together. For example, a relatively soft plastic member or a living hinge between intermediate end caps 130, 132 may be sufficient in some embodiments.

As those of skill in the art may surmise, it is advantageous if power and other electrical connections can pass between adjacent channel sections 102, 104 in the system 100. In some embodiments, electrical connecting structure, such as wires or a cable, may extend along the hinge member 134 within the covering 146. Thus, the covering 146 may hold the connecting structure to the hinge member 134 for support. With a flexible covering 146 surrounding both the wires and the hinge member 134, the hinge member 134 may beneficially relieve strain on the wires during bending of the hinge joint 106. In some embodiments, a flexible covering 146 may also be applied to the connecting structure and may provide strain relief to the connecting structure. However, wires and electrical connections may also pass outside of the flexible covering 146.

End caps, similar to the end caps 32, 50 described above, may also be secured to first and second channel sections 102, 104 in a similar manner as the intermediate caps 130, 132.

Much of this description assumes that the hinge joint 106 will be moved once. That is, the channel system 100 will be taken from its packaging, unfolded, snapped together, and left in that configuration for the rest of its service lifetime. In many applications, that may be a reasonable assumption—it is the unfolded, long channel system that is desirable; the folded configuration is used only for storage and shipping.

In some situations, the hinge member 134 has sufficient flexibility and durability to allow the channel system 100 to be unlocked from the unfolded configuration and folded again. Specifically, the hinge member 134 may bend to allow the channel sections 102, 104 to move relative to each other so that the tab 138 exits the slit 140. Thus, the channel system 100 may again be folded. The ability to unfold and fold the channel system 100 again may be useful for a number of purposes, including maintenance, storage, and ultimate disposal.

The internal configuration of each channel section 102, 104 is not critical and may vary widely from embodiment to embodiment. For example, as shown in FIG. 11, each of the sidewalls 114 has a pair of projections 122 extending from the sidewall 114 into the interior of the first channel section 102. The projections 122 run along substantially the entire length of the first channel section 102. The projections 122 are spaced apart to form an elongated notch or groove 124 that is adapted to receive the PCB 108. The PCB 108 is thus suspended between the two sidewalls 114 and forms a divider between an upper compartment and a lower compartment. However, in other embodiments, the PCB 108 could be supported on a shelf or member that itself provides a divider between the upper and lower compartments.

As was described briefly above, a lower compartment is useful in that it provides space for the hinge member 134, which may be fastened, adhered, or welded to the interior bottom 116. A lower compartment may also provide space for power conversion hardware and other elements. However, the internal proportions of the channel sections 102, 104 may vary considerably.

It is also helpful if the shape of the channel sections 102, 104 provide some structure that can be used to secure the end caps 130, 132. Threaded receptacles for fasteners may be provided along the interior sides of the channel sections 102, 104, for example. In some situations, the projections 122 may be adapted to receive a fastener or other securement means into the elongated groove 124. In such situations, it may be beneficial to reduce the width of the PCB 108 near the ends of the PCB 108 to allow the elongated notch 124 to receive the fastener without interfering with or damaging the PCB 108.

Additionally, in the illustrated embodiment, each channel section 102, 104 has hollow feet 126 with an internal cavity 128 that may also be used to secure end caps 130, 132. The feet 126 may also allow the channel system 100 to be secured to an external surface with fasteners or slid into grooves, channels, or other holding structures of complementary shape.

Channel systems 10, 100 according to embodiments of the invention may have many uses. For example, they may be particularly suitable for fluorescent tube replacements. In that case, the PCB 108 would typically be rigid and adapted to support one or more types of high-output LED light engines 110.

While the invention has been described with respect to certain embodiments, the description is intended to be exemplary, rather than limiting. Modifications and changes may be made within the scope of the invention.

What is claimed is:

1. A collapsible and self-straightening luminaire, comprising:

a pair of elongated channels mechanically linked to each other in end-to-end fashion at a hinge joint; and a length of linear lighting disposed within each of the elongated channels;

wherein the hinge joint comprises an inherently resilient hinge member extending between and attached to each of the pair of elongated channels, wherein the collapsible and self-straightening luminaire has a first, folded-over configuration and a second, straightened configuration; and wherein when the collapsible and self-straightening luminaire is in the first, folded-over configuration, a restoring moment that acts in a direction tending to cause the elongated channels to pivot back into alignment with each other and that is caused by the inherent resiliency of the hinge member exists within the hinge member.

2. The collapsible and self-straightening luminaire according to claim 1, wherein the inherently resilient hinge member comprises an elongated strip of material with a convex camber that allows the elongated strip of material to be bent out of a straight configuration when subjected to a bending moment and that causes the restoring moment such that the elongated strip of material snaps back to its straight configuration when the bending moment is removed.

3. The collapsible and self-straightening luminaire according to claim 2, wherein the inherently resilient hinge member is metal.

4. The collapsible and self-straightening luminaire according to claim 1, wherein the elongated channels have respective abutting ends and the collapsible, self-straightening luminaire further comprises an end cap disposed at each of the abutting ends of the elongated channels, with the inherently resilient hinge member extending through each end cap.

5. The collapsible and self-straightening luminaire according to claim 1, wherein the elongated channels have respective abutting ends and the collapsible, self-straightening luminaire further comprises mechanical securement structure located at each of the abutting ends of the elongated channels, the securement structure being configured and arranged to augment the restoring moment of the inherently resilient hinge member to hold the elongated channels in alignment with each other.

6. The collapsible and self-straightening luminaire according to claim 1, wherein the lengths of linear lighting disposed within the pair of elongated channels are electrically connected to each other across the hinge joint.

* * * * *